US009044368B2

(12) United States Patent
Fairburn et al.

(10) Patent No.: US 9,044,368 B2
(45) Date of Patent: Jun. 2, 2015

(54) CONFIGURABLE AIR DIFFUSION BODY SUPPORTS

(71) Applicants: Cherie B. Fairburn, Baton Rouge, LA (US); John Thomas Fairburn, Baton Rouge, LA (US)

(72) Inventors: Cherie B. Fairburn, Baton Rouge, LA (US); John Thomas Fairburn, Baton Rouge, LA (US)

(73) Assignee: Fairburn Medical Products, LLC, Baton Rouge, LA (US)

( * ) Notice: Subject to any disclaimer, the term of this patent is extended or adjusted under 35 U.S.C. 154(b) by 0 days.

(21) Appl. No.: 14/455,443

(22) Filed: Aug. 8, 2014

(65) Prior Publication Data

US 2015/0040326 A1 Feb. 12, 2015

Related U.S. Application Data

(60) Provisional application No. 61/864,294, filed on Aug. 9, 2013.

(51) Int. Cl.
*A61G 7/057* (2006.01)
*A47C 27/08* (2006.01)

(52) U.S. Cl.
CPC ..... *A61G 7/05769* (2013.01); *A47C 27/081* (2013.01)

(58) Field of Classification Search
CPC .... A47C 27/083; A47C 27/10; A47C 27/081; A61G 7/05769; A61G 7/05776
USPC ..... 5/713, 714, 710, 706, 655.3, 654, 644, 5/632
See application file for complete search history.

(56) References Cited

U.S. PATENT DOCUMENTS

| | | | | |
|---|---|---|---|---|
| 1,382,831 | A | | 6/1921 | Hilker |
| 2,612,645 | A | | 10/1952 | Boland |
| 2,874,826 | A | * | 2/1959 | Matthews et al. ..... 206/522 |
| 3,308,489 | A | | 3/1967 | Winkler |
| 3,333,286 | A | | 8/1967 | Biolik |
| 3,394,415 | A | * | 7/1968 | Parker ..... 5/713 |
| 3,867,732 | A | * | 2/1975 | Morrell ..... 5/654 |
| 4,267,611 | A | * | 5/1981 | Agulnick ..... 5/713 |
| 4,528,705 | A | | 7/1985 | Greenawalt |
| 4,932,089 | A | | 6/1990 | Laviero |

(Continued)

OTHER PUBLICATIONS

Slimline Abduction Pillow. Innovative Medical Products, Inc. 12035M. pp. 1-2.

(Continued)

*Primary Examiner* — Robert G Santos
(74) *Attorney, Agent, or Firm* — Nilay J. Choksi; Smith & Hopen, P.A.

(57) ABSTRACT

A patient positioning wedge, mattress, pillow, pod, or other surface or apparatus for preventing or relieving pressure ulcers or other types of wounds through low air loss therapy, alternating pressure therapy, or both, and the ports, controllers, and manifolds used in combination. The mattress includes a plurality of perforated or otherwise porous air cells for supporting the patient's body weight. The mattress further includes valves and accessory ports to pump air into accessories, such as patient positioning wedges, pods, and pillows. Each accessory also includes perforated or otherwise porous air cells. The air cells in the mattress and accessories allow for low air loss therapy and/or alternating pressure therapy by passing air between the contact surface of the mattress or accessory and the contact surface of the patient, thus helping alleviate pressure, heat, friction, and moisture, while maintaining support and stability of the patient.

7 Claims, 13 Drawing Sheets

(56) References Cited

U.S. PATENT DOCUMENTS

| | | | | | |
|---|---|---|---|---|---|
| 5,113,875 | A | | 5/1992 | Bennett | |
| 5,173,979 | A | | 12/1992 | Nennhaus | |
| 5,369,828 | A | * | 12/1994 | Graebe | 5/654 |
| 5,461,741 | A | * | 10/1995 | Graebe | 5/654 |
| 5,497,520 | A | | 3/1996 | Kunz et al. | |
| 5,509,155 | A | * | 4/1996 | Zigarac et al. | 5/655.3 |
| 5,657,499 | A | | 8/1997 | Vaughn et al. | |
| 5,687,438 | A | * | 11/1997 | Biggie et al. | 5/654 |
| 5,697,112 | A | | 12/1997 | Colavito et al. | |
| 5,708,999 | A | | 1/1998 | Priolo et al. | |
| 5,926,884 | A | * | 7/1999 | Biggie et al. | 5/714 |
| 6,684,425 | B2 | | 2/2004 | Davis | |
| 6,901,617 | B2 | * | 6/2005 | Sprouse et al. | 5/654 |
| 7,235,057 | B2 | | 6/2007 | LeVert et al. | |
| D587,507 | S | | 3/2009 | Martin | |
| 2003/0205920 | A1 | * | 11/2003 | Sprouse et al. | 297/219.1 |
| 2008/0178390 | A1 | | 7/2008 | DuDonis | |
| 2009/0000037 | A1 | | 1/2009 | Graebe, Jr. | |
| 2015/0040326 | A1 | * | 2/2015 | Fairburn et al. | 5/713 |

OTHER PUBLICATIONS

Invacare MA80 Series Mattresses User Manual. microAIR. Part No. 1148138. 2011. 1-36.

Posey Positioning Wedges. Posey Seating & Positioning. M6142 REV C 051513. 2013: 1.

Covidien: Positioning & Protection by Design. Covidien. H6485 5M. 2009: 1-24.

Sterile Phase 4 Gel Splint. Innovative Medical Products, Inc. 2011: 1-2.

Aire Select Operators Manual. Gaymar Industries, Inc. P/N 100562000 REV A. 2007: 1-14.

Tuffease Pressure Reducing Gel Pads. Innovative Medical Products, Inc. 2011: 1-3.

Tuffease Ordering Sheet. Innovative Medical Products, Inc. 2011: 1.

Rolyan Body Positioner. Orthopedics. Patterson Medical. Date Accessed Sep. 28, 2013. http://www.pattersonmedical.com/app.aspx?cmd=getProduct&key=IF_46370.

Rolyan Positioning Wedge. Orthopedics. Patterson Medical. Date Accessed Sep. 28, 2013. http://www.pattersonmedical.com/app.aspx?cmd=getProduct&key=IF_146993.

Bed Positioning Wedge with AEGIS. Orthopedics. Patterson Medical. Date Accessed Sep. 28, 2013. http://www.pattersonmedical.com/app.aspx?cmd=getProduct&key=IF_92850.

Rolyan Bed Wedge. Orthopedics. Patterson Medical. Date Accessed Sep. 28, 2013. http://www.pattersonmedical.com/app.aspx?cmd=getProduct&key=IF_821019246.

* cited by examiner

CONFIGURABLE AIR DIFFUSION BODY SUPPORTS

CROSS-REFERENCE TO RELATED APPLICATIONS

This nonprovisional application is a continuation of and claims priority to provisional application No. 61/864,294, entitled "Configurable Air Diffusion Body Supports", filed Aug. 9, 2013 by the same inventor, the entirety of which is incorporated herein by reference.

BACKGROUND OF THE INVENTION

1. Field of the Invention

This invention relates to patient positioning devices. More specifically, it relates to a combination supportive wedge and aircushion that provides patients with low air loss therapy and/or alternating pressure therapy.

2. Description of the Prior Art

Patients immobilized or who suffer from certain medical conditions can suffer serious destruction of the skin and soft body tissue. This often results in the formation of pressure ulcers, i.e., bed sores. A pressure ulcer is a localized injury to the skin and/or underlying tissue as a result of pressure, shear and/or friction, which causes partial or complete obstruction of the blood flow to the soft tissue. Immobility, heat, moisture, continence, medication, poor nutrition, and certain medical conditions may all contribute to development of pressure ulcers. Pressure ulcers most commonly occur at the bony prominences, including the sacrum, coccyx, heels, elbows, knees, ankles or the back of the head, and often result in chronic wounds. Pressure ulcers are a major cause of morbidity, mortality, and healthcare expense worldwide. In the United States alone, chronic wounds affect approximately 6.5 million patients, with over 1 million new cases of pressure ulcers developing each year. Complications related to pressure ulcers cause an estimated 60,000 deaths and cost over $1.3 billion annually in the United States. Worldwide, approximately 20% of hospital patients develop pressure ulcers each year. However, most pressure ulcers are treatable and even preventable.

Low air loss therapy is used for the prevention and treatment of pressure ulcers as well as other types of wounds, including venous stasis ulcers, surgical wounds, trauma wounds, lower extremity wounds, and diabetic wounds. Low air loss therapy also provides increased patient comfort for burn patients and patients with certain medical conditions such as Multiple Sclerosis or Lou Gehrig's disease. Low air loss therapy reduces skin interface pressure by allowing the patient to rest or "float" on air-filled, perforated cells, while circulating air across the skin of the patient to reduce moisture.

Currently there exist two methods of providing low air loss therapy: (1) fully integrated bed frames, in which the low air loss surface and bed frame are constructed as a single unit; and (2) a mattress replacement system, in which the mattress lays over or replaces the mattress on the bed. Although these systems are beneficial in preventing pressure ulcers, there are several limitations.

First, situations exist in which the source of the pressure to the skin is from something other than the mattress underneath the patient. For example, patients lying on their sides suffer serious problems with skin-to-skin contact (e.g., between the patient's legs), which, in turn, causes pressure, friction, and moisture between the touching skin regions (e.g., legs). As another example, bariatric patients have an increased risk of pressure ulcers and chronic wounds between skin folds (e.g., skin folds in the abdomen or hips) because the weight of the skin folds and the skin-to-skin contact can create forces that enable pressure ulcers to develop.

Second, due to human anatomy, low air loss mattresses do not provide sufficient relief for certain areas, particularly the bony prominaces. For example, even when using a traditional low air loss mattress, a patient may experience sufficient pressure on the heels, sacrum, or other bony prominances to develop pressure ulcers in those areas. Due to this issue, many hospital protocols require caregivers to reposition the patient to attempt to reduce the pressure on the bony prominances. For example, many hospital protocols require caregivers to elevate the patient's heels to relieve pressure to the heels or turn the patient onto his side to relieve pressure to the sacrum. This is conventionally accomplished by placing a traditional pillow or a foam or gel positioning device under the patient's legs to elevate the heels or behind the patient's back to position him on his side. However, this methodology blocks the low air loss mattress's effectiveness and creates a new pressure point between the patient's heels/legs/back and the traditional pillow, foam or gel positioning device.

Third, some patients require very particular positioning. For example, patients who suffer from pulmonary complications due to immobility, such as nosocomial pneumonia or acute respiratory distress syndrome ("ARDS"), experience a greater likelihood of survival if they can be placed in the prone position. Caregivers generally accomplish the positioning using foam or gel positioning wedges. These types of wedges actually create pressure, friction, and moisture along the skin region that is contacting the foam or gel positioning wedge, resulting in an increased risk of development of pressure ulcers. Further, some positions when accomplished with traditional foam or gel positioning wedges cause a risk of development of other types of complications. For example, prone positioning with a foam or gel wedge can result in damage to the facial nerves or blindness.

Fourth, surgical patients often require special positioning during or after the surgical procedure. Patients undergoing surgical procedures, particularly long surgical procedures, are at increased risk of developing pressure ulcers due to increased pressure on the capillaries when a patient is immobile because of sedation. Currently, surgical and post surgical positioning is accomplished using foam or gel positioning devices. These devices can create pressure points between the patient's body and the foam or gel positioning device, causing greater risk to a patient already at risk of developing pressure ulcers due to the surgical procedure.

Fifth, low air loss mattresses are very costly for the user/hospital and only provide low air loss therapy to the portion of the patient's anatomy that comes in direct contact with the mattress and thus provide only incomplete coverage as well.

The prior art has seen various types and configurations of aircushions. Examples include U.S. Pat. No. 1,382,831 to Hilker; U.S. Pat. No. 2,612,645 to Boland; U.S. Pat. No. 3,308,489 to Winkler; U.S. Pat. No. 3,333,286 to Biolik; U.S. Pat. No. 4,528,705 to Greenawalt; U.S. Pat. No. 4,932,089 to Laviero; U.S. Pat. No. 5,113,875 to Bennett; U.S. Pat. No. 5,173,979 to Nennhaus; U.S. Pat. No. 5,497,520 to Kunz; U.S. Pat. No. 5,657,499 to Vaughn, U.S. Pat. No. 5,697,112 to Colavito; U.S. Pat. No. 5,708,999 to Priolo; U.S. Pat. No. 6,684,425 to Davis; U.S. Pat. No. 7,235,057 to LeVert; U.S. Patent Pub. No. 2008/0178390 to DuDonis; U.S. Patent Pub. No. 2009/0000037; and U.S. Design Pat. No. D587,507 to Martin.

However, none of these aircushions are structured or designed for low air loss or alternating pressure therapy to relieve pressure ulcers or other wounds. Further, many of the references do not include supportive (e.g., foam, air cells, etc.) bases for added support when positioning patients. If supportive bases are included, the supportive base directly contacts the patient, which causes a pressure point which could result in further damage of pressure ulcers. Additionally, none of the prior art addresses the patient microclimate, or the air entering the area to help tissue remain dry and cool, which is one of the most significant factors contributing to development of pressure ulcers. Direct contact between any support base and the patient actually teaches away from the current invention.

Accordingly, what is needed is an economic device that can be easily positioned to support patients while still providing low air loss therapy and/or alternating pressure therapy. However, in view of the prior art considered as a whole at the time the present invention was made, it was not obvious to those of ordinary skill in the art how the limitations of the art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an improved patient positioning wedge or mattress that provides patients with low air loss therapy and/or alternating pressure therapy is now met by a new, useful, and nonobvious invention.

In an embodiment, the current invention is a low air loss or alternating pressure patient positioning system. The system includes mattress having a top side, a bottom side, and a plurality of sidewalls that spatially confine the interior of the mattress. An array of perforated air cells or air cells made from a material that permits the flow of a fluid through the material, such as high vapor rate transmission fabrics, forms the top side of the mattress and permits the flow of a fluid (e.g., air) from a substantially hollow interior of each air cell to an exterior of the air cells. One or more air distribution manifolds are coupled to each air cell for distribution of the fluid into the air cells. An air source is coupled to the air distribution manifolds for pumping the fluid from the air source into the manifolds and subsequently into the air cells to inflate the air cells in order to support the patient. An accessory port is positioned external to the spatial confines of the mattress but is in controlled communication with the air distribution manifolds via a control valve, where the valve is coupled to the air distribution manifolds and the accessory port is coupled to the valve. The accessory port can be connected to a low air loss support accessory for distributing fluid from the manifolds into the accessory through the accessory port, thus controlling the extent to which a patient or a portion of the patient's anatomy will be immersed into the support accessory.

The valve may be positioned within the spatial confines of the sidewalls.

The mattress and air cells can each define a longitudinal axis and a transverse axis. The longitudinal axis of each air cell may be disposed substantially parallel to the transverse axis of the mattress, where the air cells abut each other along their respective longitudinal axis down the longitudinal axis of the mattress. In a further embodiment, the air distribution manifolds may have a longitudinal extent that is substantially parallel to the longitudinal axis of the mattress and coupled to each air cell along the longitudinal axis of the mattress. In yet a further embodiment, there may be two (2) air distribution manifolds, one positioned down each longitudinal sidewall of the mattress, where the manifolds are alternately coupled to adjacent air cells.

A control mechanism may be positioned external to the spatial confines of the sidewalls and in communication with the control valve. The control mechanism can engage and disengage the valve in order to permit and prohibit fluid flow from the air distribution manifolds into the accessory port.

The low air loss support accessory may be a pillow or pod coupled to the accessory port via an elongate tubing. The pillow/pod includes a perforated air cell or an air cell made from a material that permits the flow of a fluid through the material, such as high vapor rate transmission fabrics, surrounded by a perforated cover or a cover made from a material that permits the flow of a fluid through the material. The pillow/pod may be of any shape or size.

Alternatively, the low air loss support accessory may be a patient positioning wedge coupled to the accessory port via an elongate tubing. The wedge includes a support layer having a contact surface and one or more perforated air cells or air cells made from a material that permits the flow of a fluid through the material covering or surrounding the contact surface. In a further embodiment, the wedge can have a generally triangular prismic shape with a base (support layer), where the contact surface is a substantially planar, angled surface. The angled surface would be covered by the air cells. In yet a further embodiment, the air cells can be a substantially planar air cell layer formed of a plurality of air cells with a fluid channel disposed between each.

Alternatively, the wedge can have a generally cylindrical shape with a cylindrical base (support layer), where the contact surface is around the circumference of the base. Thus, the cylindrical base would be surrounded by the air cells. In a further embodiment, the air cells may be elongate and have a longitudinal axis that is substantially parallel to the longitudinal axis of the cylindrical base. The air cells would abut each other along their respective longitudinal axes around the circumference of the base.

In a separate embodiment, the current invention is a low air loss pillow or pod system. The system includes a perforated air cell or air cell made from a material that permits the flow of a fluid through the material, such as high vapor rate transmission fabric, directly or indirectly coupled to an air source via an elongate tubing through an aperture in the air cell. A perforated cover or cover made from a material that permits the flow of a fluid through the material surrounds the air cell. The cover also has an aperture, such that the apertures of the air cell and cover are aligned to allow the tubing to be disposed therethrough in order to provide fluid communication between the air source and the interior of the air cell. In this embodiment, fluid flow follows a path of travel from the air source, through the tubing, into the substantially hollow interior of the air cell via the apertures in the air cell and cover, through the perforations of the air cell, through the perforations of the cover, and into an environment external to the pillow/pod system.

In a separate embodiment, the current invention is a low air loss patient positioning wedge system. The system includes a resilient, non-perforated base having a contact surface, where the contact surface is any side of the base intended to be contacted by a user. An air cell layer formed of one or more perforated air cells or air cells made from a material that permits the flow of a fluid through the material covers or surrounds the contact surface of the base, such that the user would not physically contact the contact surface of the base but would rather contact the air cell layer thereon. The air cell layer is directly or indirectly connected to an air source via an elongate tubing through an aperture in the air cell layer in order to provide fluid communication between the air source and the substantially hollow interior of each air cell. In this embodiment, fluid flow follows a path of travel from the air source, through the tubing, into the substantially hollow interior of the air cells via the aperture in the air cell, through the perforations of or material comprising the air cells, and into an environment external to the pillow/pod system.

A perforated cover or cover made from a material that permits the flow of a fluid through the material may surround the base and air cell layer, where the cover also has an aperture that would be aligned with the aperture in the air cell layer, such that the apertures of the air cell and cover are aligned to allow the tubing to be disposed therethrough in order to provide fluid communication between the air source and the interior of the air cells. In this embodiment, fluid flow follows a path of travel from the air source, through the tubing, into the substantially hollow interior of the air cells via the apertures in the air cell and cover, through the perforations of or material comprising the air cells, through the perforations of or material comprising the cover, and into an environment external to the pillow/pod system.

The base can have a generally triangular prismic shape, where the contact surface is a substantially planar, angled top surface of the base. This angled surface would be covered by the air cell layer. In a further embodiment, the air cell layer may be substantially planar and include a fluid channel disposed between each air cell therein.

Alternatively, the base can have a generally cylindrical base, where the contact surface is a circumference of the base. The cylindrical base would be surrounded by the air cell layer about its circumference. In a further embodiment, the air cells can be elongate and define a longitudinal axis. The elongate air cells would be disposed substantially parallel to the longitudinal axis of the cylindrical base, where they abut each other along their respective longitudinal axis around the circumference of the base. In yet a further embodiment, an air distribution manifold can be coupled on one end to the elongate tubing and further coupled to each elongate air cell for the distribution of fluid from the manifold into each air cell in order to provide fluid communication between the air source and the interior of each air cell.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1A:
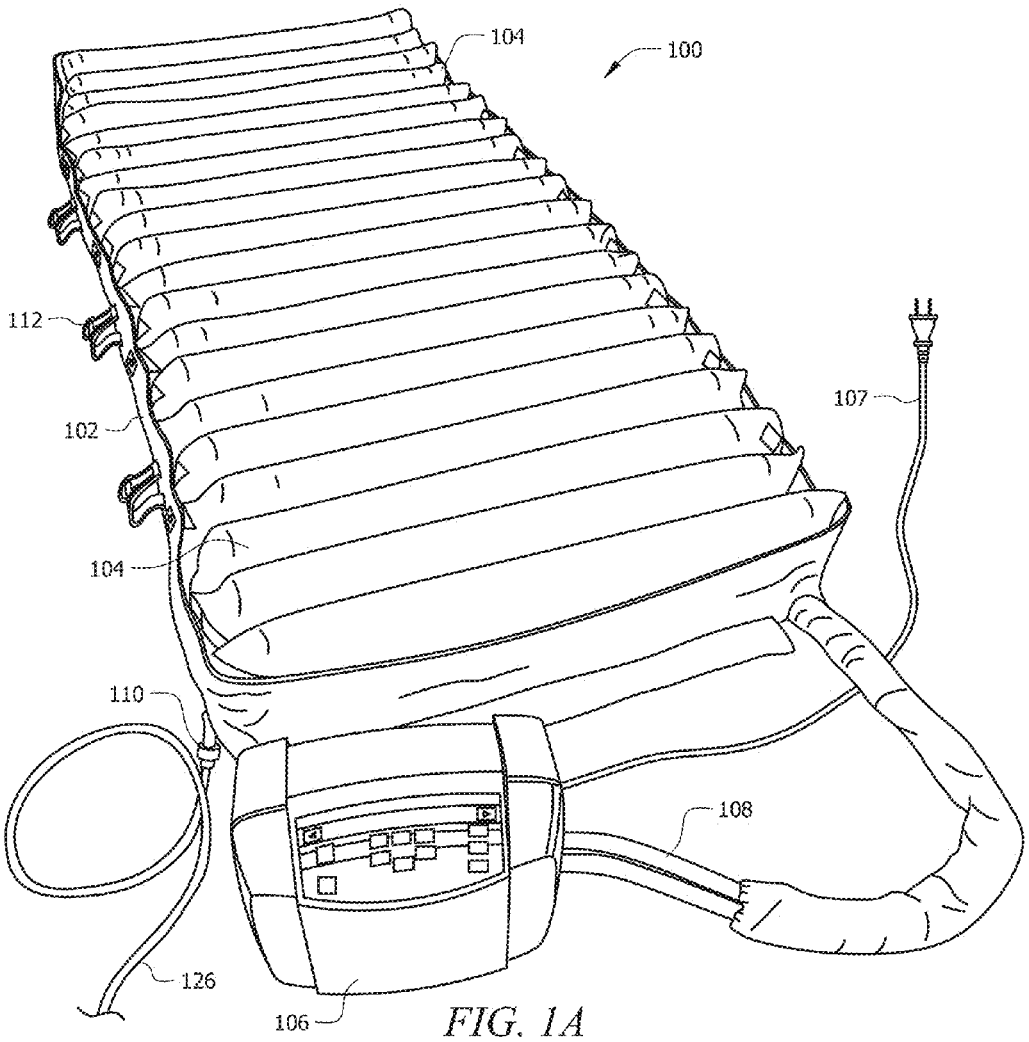
FIG. 1A is a perspective view of a low air loss mattress according to an embodiment of the current invention.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The novel invention is a patient positioning wedge, mattress, pillow, pod or other surface or apparatus for relieving or treating pressure ulcers or other wounds through low air loss therapy, alternating pressure therapy, or both, and the ports, controllers, and manifolds used in combination.

A mattress includes a frame and one or more porous or perforated air cells or air cells made from a material that permits the flow of a fluid through the material, such as high vapor rate transmission fabrics (e.g., GORE-TEX), contained therein for supporting the body weight of the patient. The air cells are connected to an air pump via a manifold that feeds air or other fluid from the air pump into each air cell. An additional manifold or manifolds can run throughout the mattress, with one or more valves and one or more accessory ports located at various points throughout the mattress, where each accessory port is generally positioned outside of the frame of the mattress. The valve controls the amount of air passed from the manifold into the accessory port. The accessory port can then be coupled to an accessory (e.g., typically a patient positioning apparatus, such as a wedge, pillow, pod, etc.), which would also contain one or more porous or perforated, inflatable air cells or air cells made from a material that permits the flow of a fluid through the material.

The patient positioning wedge includes a base formed of a resilient material, such as foam, static air cushion, or other supportive material. The base can be any shape or size (e.g., triangular prism, cylindrical, etc.) that is necessary for patient support. The support or contact surface of the base (i.e., the surface that would contact a user; typically the top surface) includes thereon or therearound an air cell layer or one or more air cells which contain perforations that allow fluid to pass through the air cells or which are made of a material that permits the flow of a fluid through the air cells that can be inflated and deflated, in order to form the patient positioning wedge.

Methodologically, the wedge is arranged in the necessary position to support the patient or to reduce pressure from certain portions of the patient's body, such as the bony prominences or between skin folds. The air cells allow for low air loss therapy or, alternatively, are inflated and deflated providing alternating pressure therapy, or provide both low air loss and alternating pressure therapies. The air cells help alleviate pressure points by allowing that portion of the patient's body contacting the cells to "sink" into the air cells, thus increasing the skin surface area in contact with the surface of the patient positioning device, thereby reducing interface pressure. Additionally, the air cells reduce heat, friction, and moisture by allowing air to pass between the air cell layer or air cells and the contact surface of the patient's skin. By reducing skin interface pressure, heat, friction, and moisture, the patient positioning device helps prevent pressure ulcers and allows existing wounds or other damage on that contact surface to heal more effectively.

It is contemplated that in certain embodiments, rather than utilizing foam, a portion of the wedge can be formed of a supportive core, such as an inflatable core or one or more air cells. This tends to reduce cost of manufacture while still preserving the supportive functionality of the base. In these cases, a separate manifold may be needed for inflation.

The side of the wedge (typically bottom side) that contacts the support surface (e.g., mattress) of the individual may have a non-skid or non-slip surface in order to hold the individual in place.

In any embodiment, the current invention can be reusable or disposable and thus be formed of the appropriate materials.

EXAMPLES

The following non-limiting examples of the current invention are intended to exemplify the invention without limiting the scope of the invention.

Mattress

In an embodiment, depicted in FIGS. 1A-1D, the current invention is a low air loss mattress, generally denoted by the reference numeral 100. Referring specifically to FIG. 1A, mattress system 100 has a top side, bottom side, left side, right side, front side, and rear side, where the front and rear sides define a longitudinal axis of mattress system 100 and the left and right sides define a transverse axis of mattress system 100. The front, rear, left, right, and bottom sides can be defined by frame 102, which typically is flexible or formed of a cloth-type material.

Figure 1B:
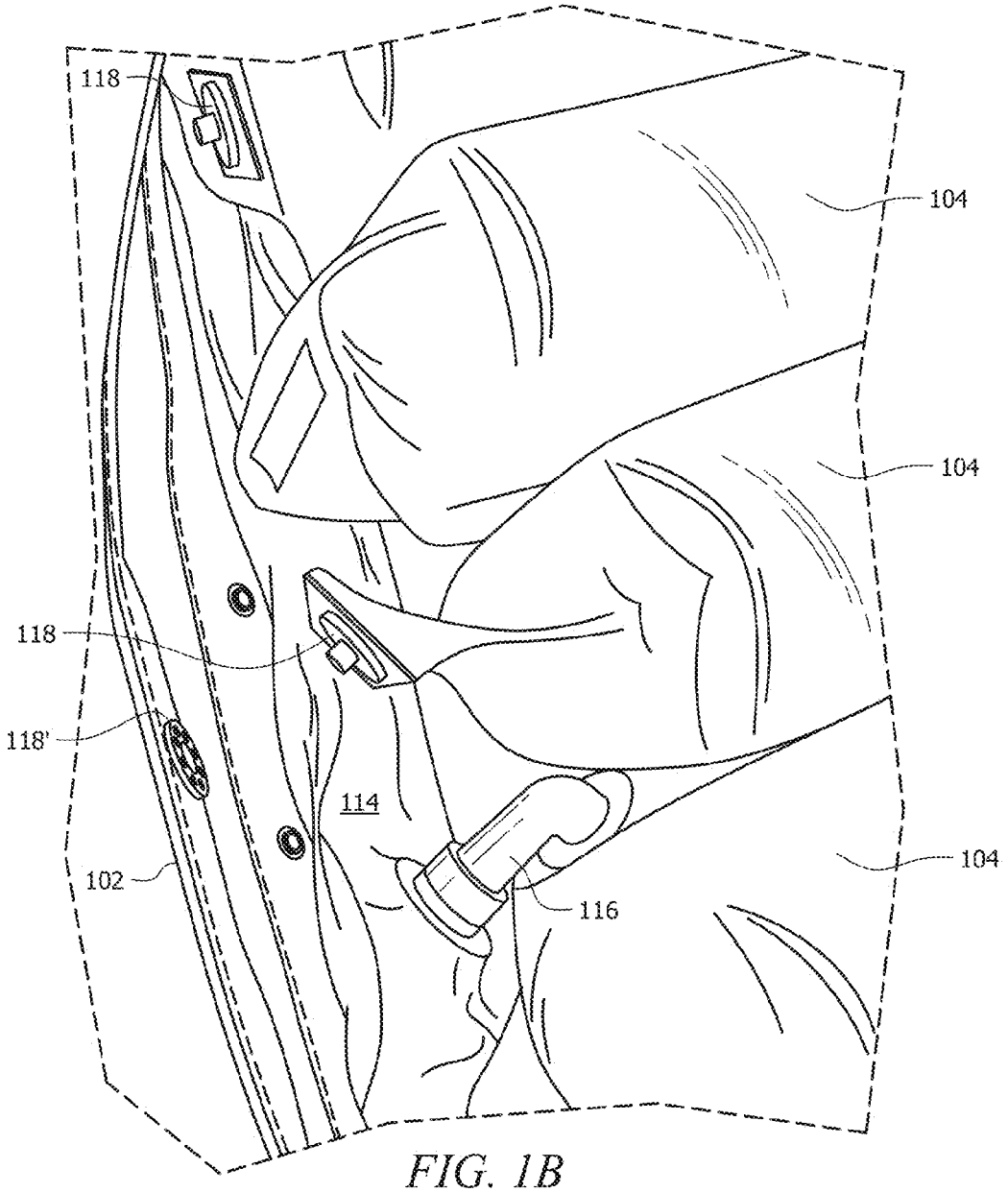
FIG. 1B is a close-up view of a connection of an air cell within the mattress of FIG. 1A.
Figure 1C:
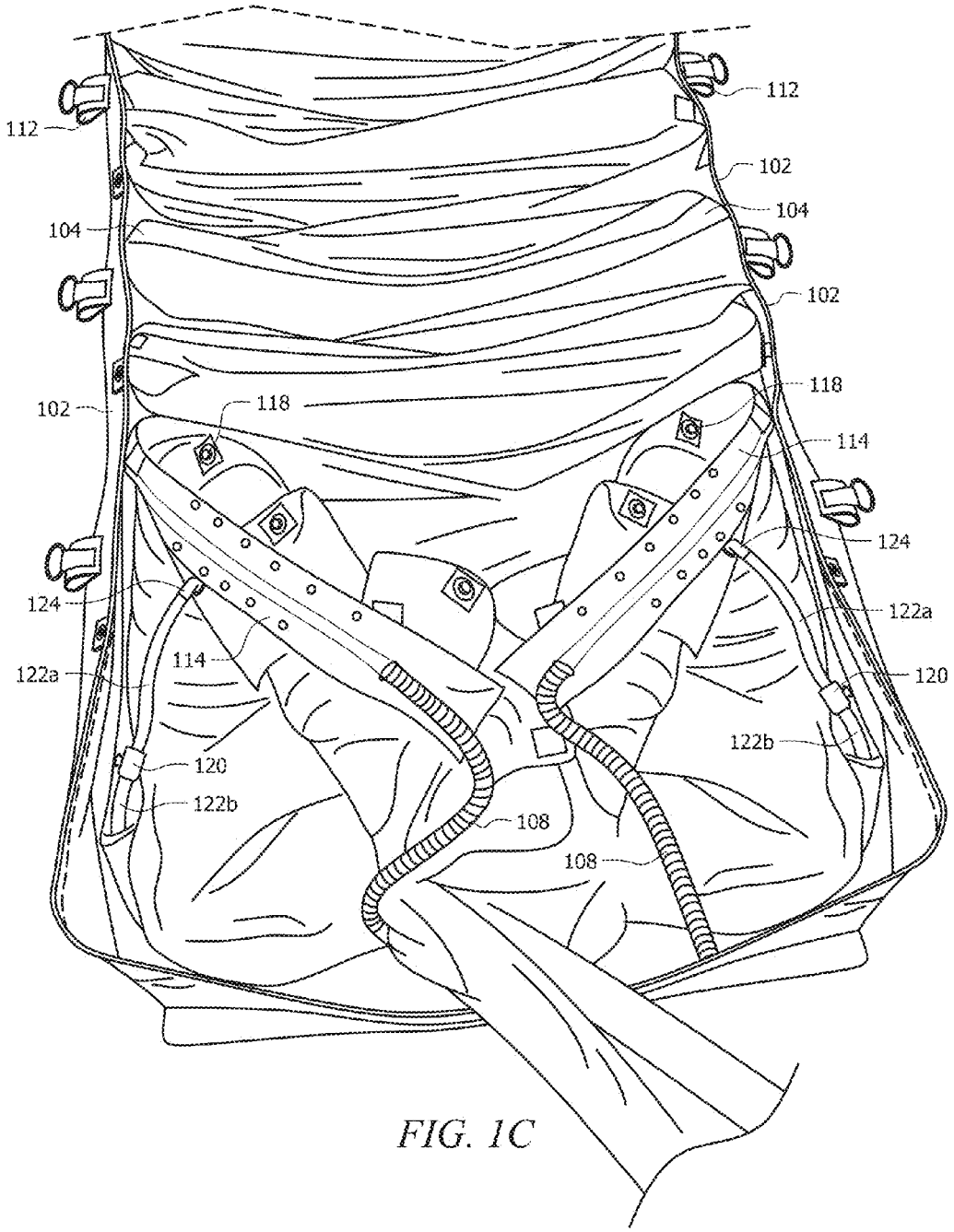
FIG. 1C is an elevated internal partial view of two (2) corners of the mattress of FIG. 1A.

Frame 102 has an open top that contains an array of porous or perforated air cells 104 or air cells made from a material that permits the flow of a fluid through the material, such as high vapor rate transmission fabrics (e.g., GORE-TEX). Air cells 104 can have any suitable shape or configuration, though each would have a substantially hollow interior and a contact surface (i.e., the surface that contacts the patient or user) that is perforated (or formed from a material that permits the flow of a fluid through the material), such that air can be forced out of the interior, through the perforations, and passed between the contact surface and skin of the patient. In FIGS. 1A-1C, air cells 104 are each elongate cylindrical compartments disposed across the transverse axis of mattress system 100. Air cells 100 abut each other along their respective longitudinal axes, so that there are a sufficient number of air cells 100 to be disposed along the longitudinal axis of mattress system 100.

Air cells 104 can be inflated using air pump 106 or other suitable device. Air pump 106 can be electrically powered 107 (or battery-operated) and be coupled directly or indirectly to each air cell 104 via air hose 108. Air pump 106 pushes air into each air cell 104 in order to support the body weight of the patient or user. Typically, air pump 106 would be constantly activated during use of mattress system 100 to replenish any air that exits air cells 104 through their perforations.

Mattress system 100 further includes an additional manifold or manifolds that supply air to one or more accessory ports, denoted as reference numeral 110. Accessory port 110 is capable of connecting to a variety of inflatable accessories (e.g., pod, pillow, wedge, etc.) in order to inflate the accessories. Accessory port 110 will become clearer as this specification continues.

Mattress system 100 may further include a plurality of multi-purpose handles 112, which may be used to transport the mattress, secure the mattress, etc.

Air pump 106 can push air or fluid into air cells 104 in any suitable manner. Now referring to FIG. 1B as an exemplary method of the structure of pumping air or fluid into air cells 104, this can be accomplished via an elongate air distribution channel or manifold, denoted by the reference numeral 114. In this case, air hose 108 would be directly coupled to manifold 114, and manifold 114 would be coupled to each of air cells 104 via connector 116. Connector 116 may be rigid so as to preserve airflow between manifold 114 and air cells 104. In this particular embodiment as well, connector 116 would be present between each air cell 104 and manifold 114. As such, one or more manifolds 114 can extend along the longitudinal length of mattress system 100 within frame 102 on each side of and/or underneath air cells 104.

In practice, air or other fluid would be pumped from air pump 106 through air hose 108 and into manifold 114, thereby inflating manifold 114. Subsequently, because connectors 116 provide fluid communication between the interior of manifold(s) 114 and the interior of air cells 104, air can be pushed from manifold 114 into air cells 104, thereby inflating air cells 104. Air would then flow out of the perforations or through the material disposed in air cells 104 and be replenished by additional air pumped in by air pump 106 through manifold 114.

Each air cell 104 can be secured to the sidewalls of frame 102. The connection configuration and position between air cell 104 and frame 102 can be of any suitable type and would typically depend on the type and configuration of air cell 102 used in the mattress. If air cell 102 is elongate and transversely positioned, as seen in FIG. 1A, the connection type can be seen in FIG. 1B, where male component 118 would engage female component 118' to secure air cell 102 to the left and/or right side of frame 102. Further, these connections 118, 118' may interchange between adjacent air cells 104, such that one air cell would be secured to the left sidewall and an adjacent sidewall would be secured to the right sidewall, and so on.

Now referring to FIG. 1C, the direct connection between air hose 108 and manifold 114 can be seen, along with male component 118 on an end of each air cell 104, all within frame 102.

Figure 1D:
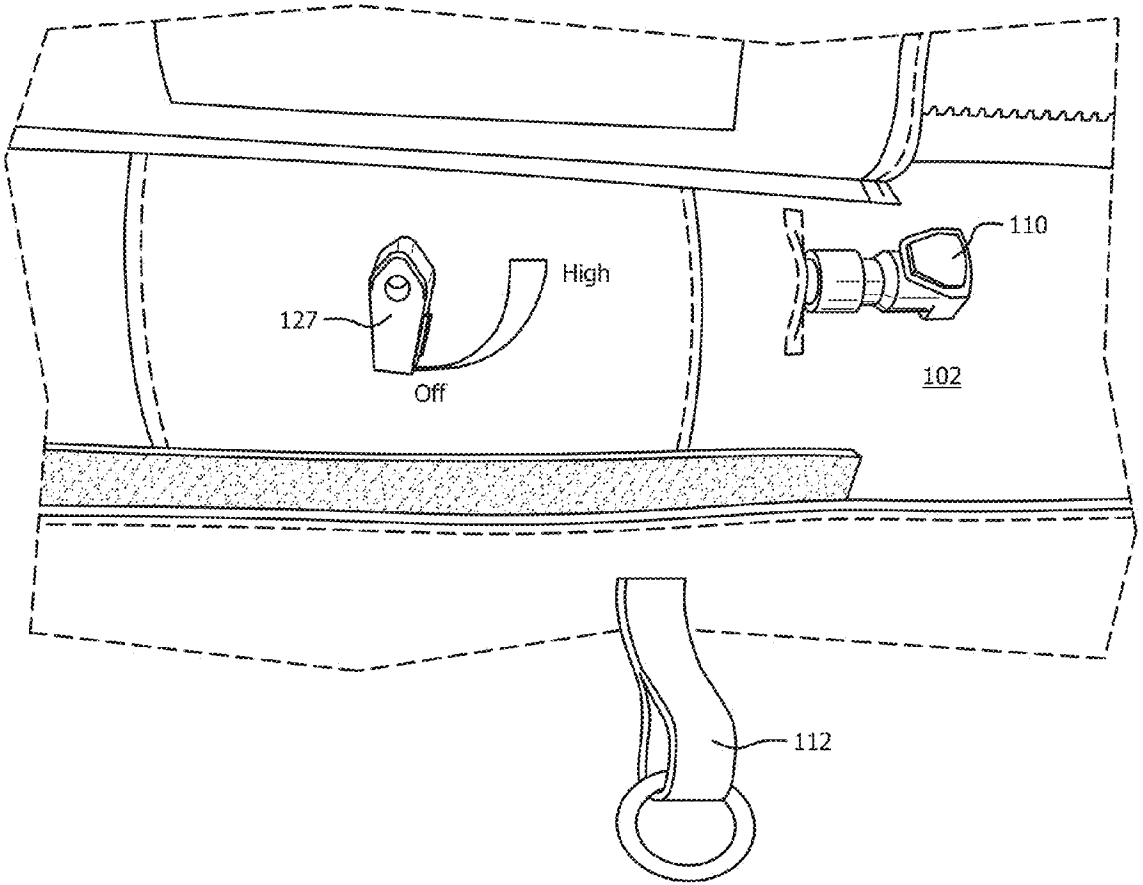
FIG. 1D is a close-up external view of an accessory port and pump valve of the mattress of FIG. 1A.

Still referring to FIG. 1C and further referring to FIG. 1D, valve 120 is depicted positioned within the spatial boundaries of frame 102. Valve 120 forms a part of the overall accessory port mechanism, as will become clearer as this specification continues. Although only two (2) corners of mattress system 100 are shown in FIG. 1C with valve 120, it is contemplated that all four (4) corners of mattress system 100 includes valve 120, similarly structured.

Tubing 122*a* can be seen extending in one direction from valve 120, and tubing 122*b* can be seen extending in the opposite direction from valve 120. Tubing 122*a* is used to connect valve 120 to manifold 114. Tubing 122*a* is coupled to manifold 114 at reference numeral 124. Valve 120 can be a shut off valve that prevents any fluid from passing from tubing 122*b* through valve 120 and into 122*a*, and vice versa. Tubing 122*b* is used to connect valve 120 to accessory port 110 and traverses through a sidewall of frame 102, as valve 120 is positioned within frame 102 and accessory port 110 is positioned external to frame 102. Tubing 122*b* is coupled to accessory port 110.

Now referring to FIG. 1D, control mechanism 127 can be seen and is typically positioned on the direct opposite side of the sidewall of frame 102 from valve 120. Control mechanism 127 allows for variable, adjustable airflow through valve 120. As control mechanism 127 is switched, rotated, or otherwise shifted to an "off" position, valve 120 shuts off, thus preventing airflow between tubing 122*a* and tubing 122*b* through valve 120. As control mechanism 127 is switched, rotated, or otherwise shifted to an "on" or "high" position, valve 120 opens to permit airflow between tubing 122*a* and tubing 122*b* through valve 120.

FIG. 1D also shows accessory port 110. Each of accessory ports 110 are indirectly coupled to manifold 114 in order to provide fluid movement of air from inside manifold 114 to the accessories (e.g., wedges, cushions, pillows, pods) used outside of or on top of mattress system 100. Accessory ports 110 typically are located on the outside of the mattress for easy access and connection. Any known port may be used as accessory port 110, so long as the port can receive and be secured to a hose or tubing through which air would be pushed. For example, accessory port 110 can include a T-valve with a female pinch lock structured to receive a male tip from accessory tubing 126. On each side of the T-valve would be coupled a supplementary manifold. Accessory tubing 126 is connected on one end to an accessory (e.g., pod, pillow, wedge, etc.) with the opposite end terminating in the male tip that is to be inserted into the female pinch lock of accessory port 110, thus permitting fluid communication between accessory tubing 126 and the supplementary manifold.

Accessory tubing 126 may include an inline valve positioned along the length of accessory tubing 126 for controlling softness and firmness of the accessory by controlling the amount of air to be pushed into the accessory. The inline valve can be used to control the air volume of the accessories outside of mattress system 100. The valve would be attached to the supply line using air from manifold 114.

Accessory ports 110 may tie directly into manifolds of any number of accessory tubings 126 (e.g., 3, 2, 1). Accessory ports 110 use air from manifold 114 to power inflate accessories (e.g., pillows, wedges, pod, etc.) outside of mattress system 100.

Accessory port 110 can be fluidly engaged to any pod, pillow, wedge, or other apparatus utilized for low air loss therapy. For example, a pod can be coupled to a first accessory port, a cylindrical wedge can be coupled to a second accessory port, a triangular wedge can be coupled to a third accessory port, and an elongated pillow can be coupled to a fourth accessory port. Each accessory port 110 can include the valve for controlling the pressure inside the attached accessory.

In practice, air or other fluid would be pumped from air pump 106 through air hose 108 and into manifold 114, thereby inflating manifold 114. Subsequently, because valve 120 and tubings 122*a*, 122*b* provide fluid communication between the interior of manifold(s) 114 and accessory port 110 when control mechanism 127 is disposed in an open position, air can be pushed from manifold 114 into accessory port 110 and thus into accessory tubing 126, thereby inflating or actuating the particular accessory, which will become clearer as this specification continues. Air would then flow out of the perforations disposed in the air cells in the accessory and be replenished by additional air pumped in by air pump 106 through manifold 114.

As discussed previously, it is contemplated that the accessory port mechanism—including accessory port 110, valve 120, tubings 122*a*,122*b*, connection 124 between tubing 122*a* and manifold 114, and control mechanism 127—is disposed at each corner of mattress system 100. However, any number of accessory port mechanisms can be placed throughout the mattress and at various locations throughout the mattress system without departing from the scope of the invention.

Pillow/Pod

Figure 2:
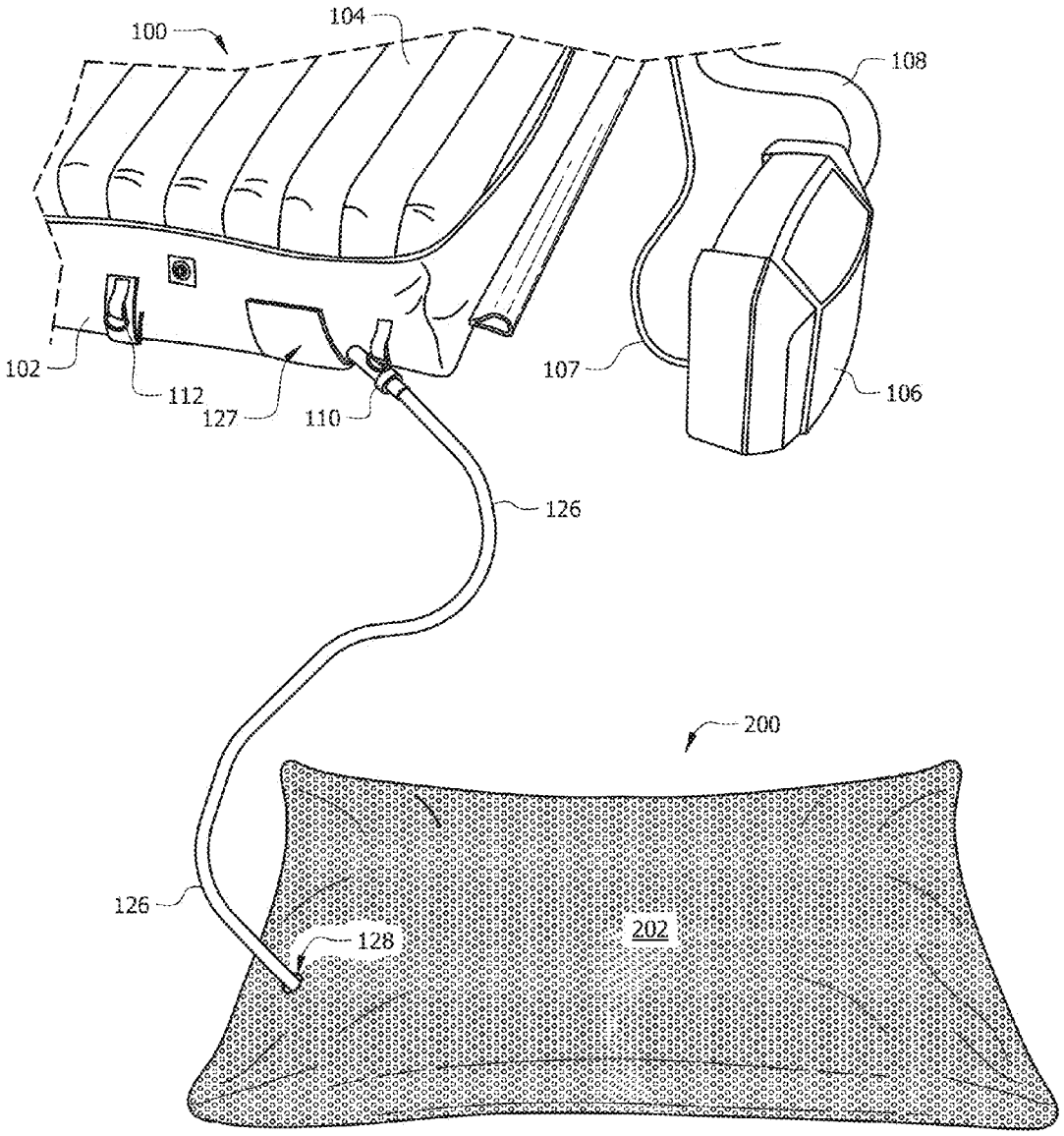
FIG. 2 depicts a connection between the mattress of FIG. 1A and a low air loss pillow or pod system, according to an embodiment of the current invention.

In an embodiment, as seen in FIG. 2, the current invention includes a low air loss pillow or pod system, generally denoted by the reference numeral 200. Pillow/pod system 200 includes one or more porous or perforated air cells (not shown; in FIG. 2, there is one (1) air cell) with perforated cover 202. Perforated cover 202 and the air cell would each have an aperture for receiving and connecting to accessory tubing 126 at point 128. Pillow/pod system 200 and/or the air cell(s) may be any shape or size depending on the desired use.

It is contemplated herein that the air cell and cover 202 is not required to be perforated but rather formed from a material that permits the flow of a fluid through the material, such as high vapor rate transmission fabrics (e.g., GORE-TEX).

Accessory tubing 126 is coupled on one end to pillow system 200 at point 128 and is coupled on its opposite end to accessory port 110 (which is connected directly or indirectly to air pump 106, as discussed), directly to air pump 106, or other mechanism for inflating or continually pushing air into pillow/pod system 200.

As shown in FIG. 2, where pillow/pod system 200 is indirectly coupled to air pump 106, such that air pump 106 provides air flow into pillow/pod system 200, air or other fluid would be pumped from air pump 106 through air hose 108 and into manifold 114, thereby inflating manifold 114. Subsequently, because valve 120 and tubings 122*a*, 122*b* provide fluid communication between the interior of manifold(s) 114 and accessory port 110 when control mechanism 127 is disposed in an open position, air can be pushed from manifold 114 into accessory port 110 and thus into accessory tubing 126, thereby inflating or actuating pillow/pod system 200. Air would then flow out of the perforations in the air cell and cover 202 in pillow/pod system 200 and be replenished by additional air pumped in by air pump 106 through manifold 114.

In an alternative embodiment, as seen in FIGS. 5A-5D, the current invention can be a pod system, generally denoted by the reference numeral 500. Pod system 500 includes one or more porous or perforated air cells or air cells 504*a*, 504*b* constructed of a porous material. Air cells 504*a*, 504*b* would each have an aperture for receiving and connecting to accessory tubing 126 at point 128 (see previous figures). Pod system 500 and/or air cell 504*a*, 504*b* may be any shape or size depending on the desired use, though each would have a substantially hollow interior and a contact surface (i.e., the surface that contacts the patient or user) that is perforated or porous, such that air can be forced out of the interior, through the perforations or porous material, and passed between the contact surface and skin of the patient.

Similar to other embodiments, where pod system 500 is indirectly coupled to air pump 106, such that air pump 106 provides air flow into pod system 500, air or other fluid would be pumped from air pump 106 through air hose 108 and into manifold 114, thereby inflating manifold 114. Subsequently, because valve 120 and tubings 122*a*, 122*b* provide fluid communication between the interior of manifold(s) 114 and accessory port 110 when control mechanism 127 is disposed in an open position, air can be pushed from manifold 114 into accessory port 110 and thus into accessory tubing 126, thereby inflating or actuating pod system 500. Air would then flow out of the perforations in air cells in pod system 204 and be replenished by additional air pumped in by air pump 106 through manifold 114.

Methodologically, the pods or air cells are arranged in the necessary position to support the patient or to reduce pressure from certain portions of the patient's body, such as the face, bony prominences, between the legs, or between skin folds. For example, the pods may be placed between skin folds of a patient such that when the air source is turned on, the pods inflate and provide low air loss therapy, preventing skin-on-skin contact between the skin folds and reducing heat, friction, and moisture by allowing air to pass between the air cell layer or air cells and the contact surface of the patient's skin. By reducing skin interface pressure, heat, friction, and moisture, the patient positioning device helps prevent pressure ulcers and aids healing of existing wounds or other skin damage.

Figure 5A:
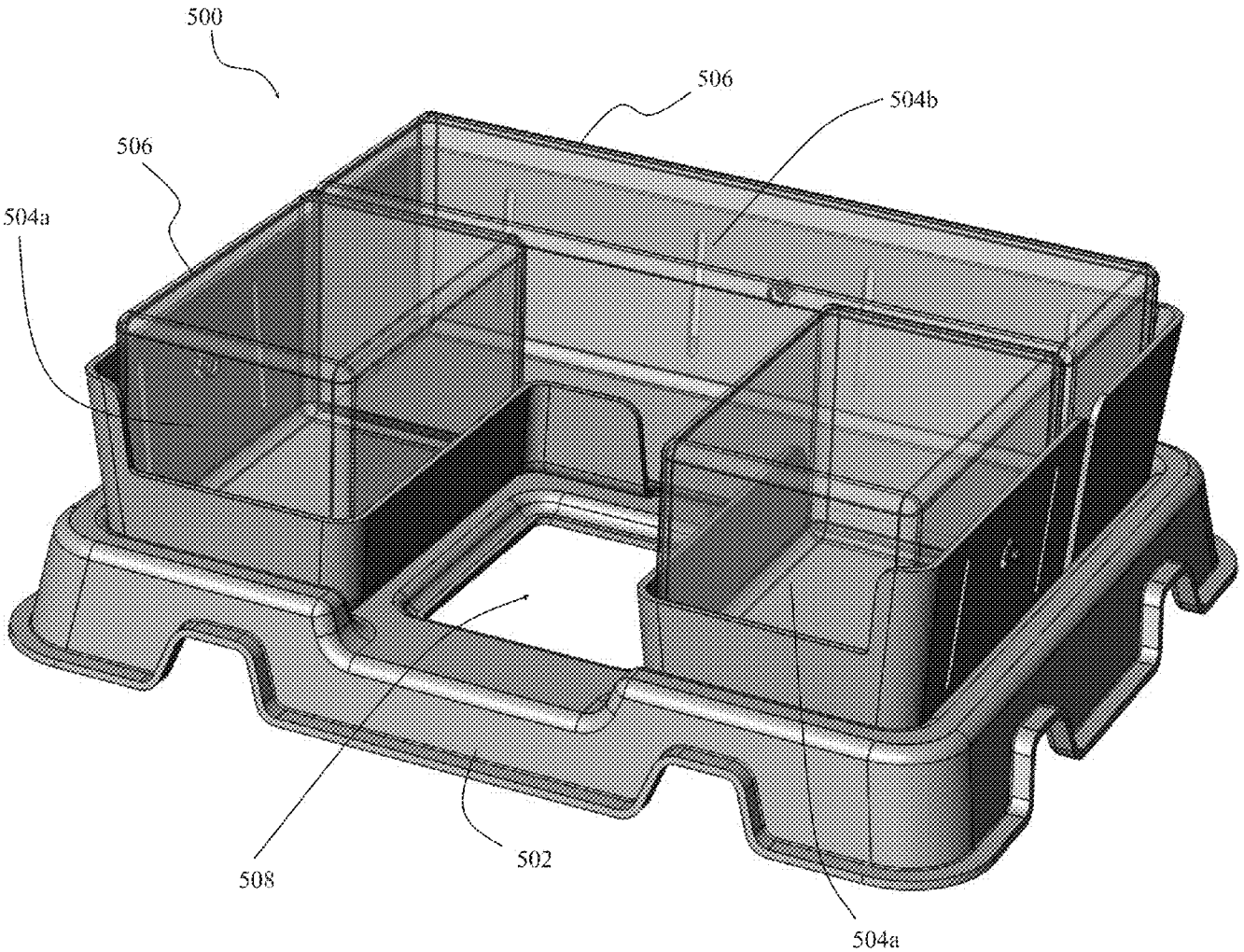
FIG. 5A is a perspective view of an alternative pod system in an extended position according to an embodiment of the current invention.
Figure 5B:
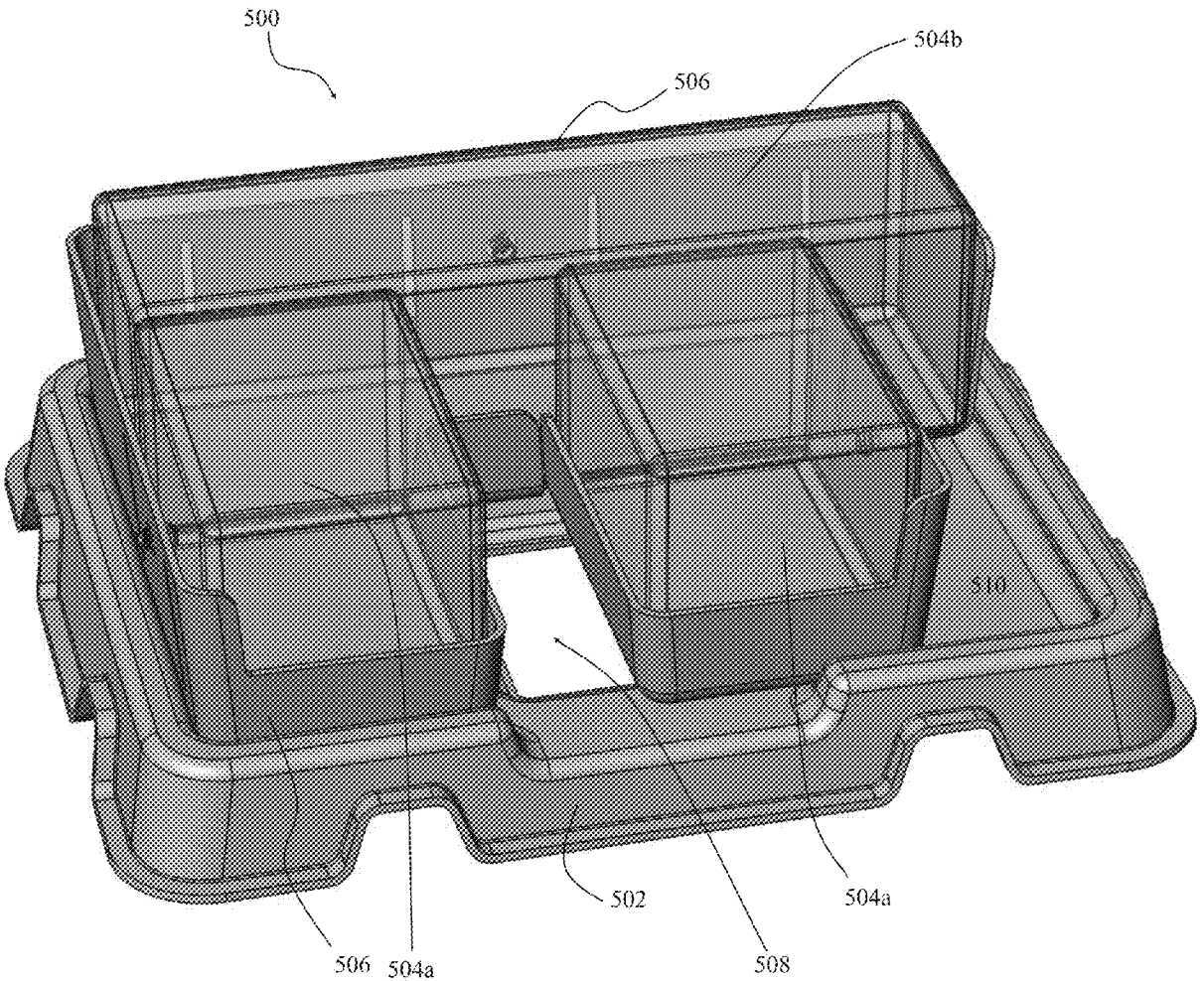
FIG. 5B is a top view of the pod system of FIG. 5A.

As a further example, pods or air cells 504*a*, 504*b* may be placed into a rigid positioning device, such as pod system 500 shown in FIGS. 5A-5B, and the part of the patient's anatomy requiring support placed on pods 504*a*, 504*b*, which are in rigid positioning device 500, thus providing low air loss support and improved microclimate to the body part that is floated on pods 504*a*, 504*b*. For example, when placing a patient in the prone position, the face could be positioned upon pods 504*a*, 504*b* that are positioned in a rigid positioning device, thus providing low air loss support to the facial area reducing pressure on the facial tissues and nerves to reduce the risk of pressure ulcers, facial nerve damage, and blindness.

Structurally, prone positioning system 500 includes base 502, lateral air cells 504*a* for supporting the lateral aspects of a patient's face in a prone position, and air cell 504*b* for supporting the forehead of the patient's face in the prone position. Frame 506 is used around different aspects of air cells 504*a*, 504*b* in order to maintain positioning of air cells 504*a*, 504*b*, so that the patient's face can be maintained in a rigid position. In the prone position, the patient's face would be positioned within opening 508 between lateral air cells 504*a*.

It is contemplated herein that each of air cells 504*a*, 504*b* can be directly or indirectly coupled to air source 106 separately. Alternatively, only one of air cells 504*a*, 504*b* can be directly or indirectly coupled to air source 106, and air cells 504*a*, 504*b* would be in fluid communication with each other.

Figure 5C:
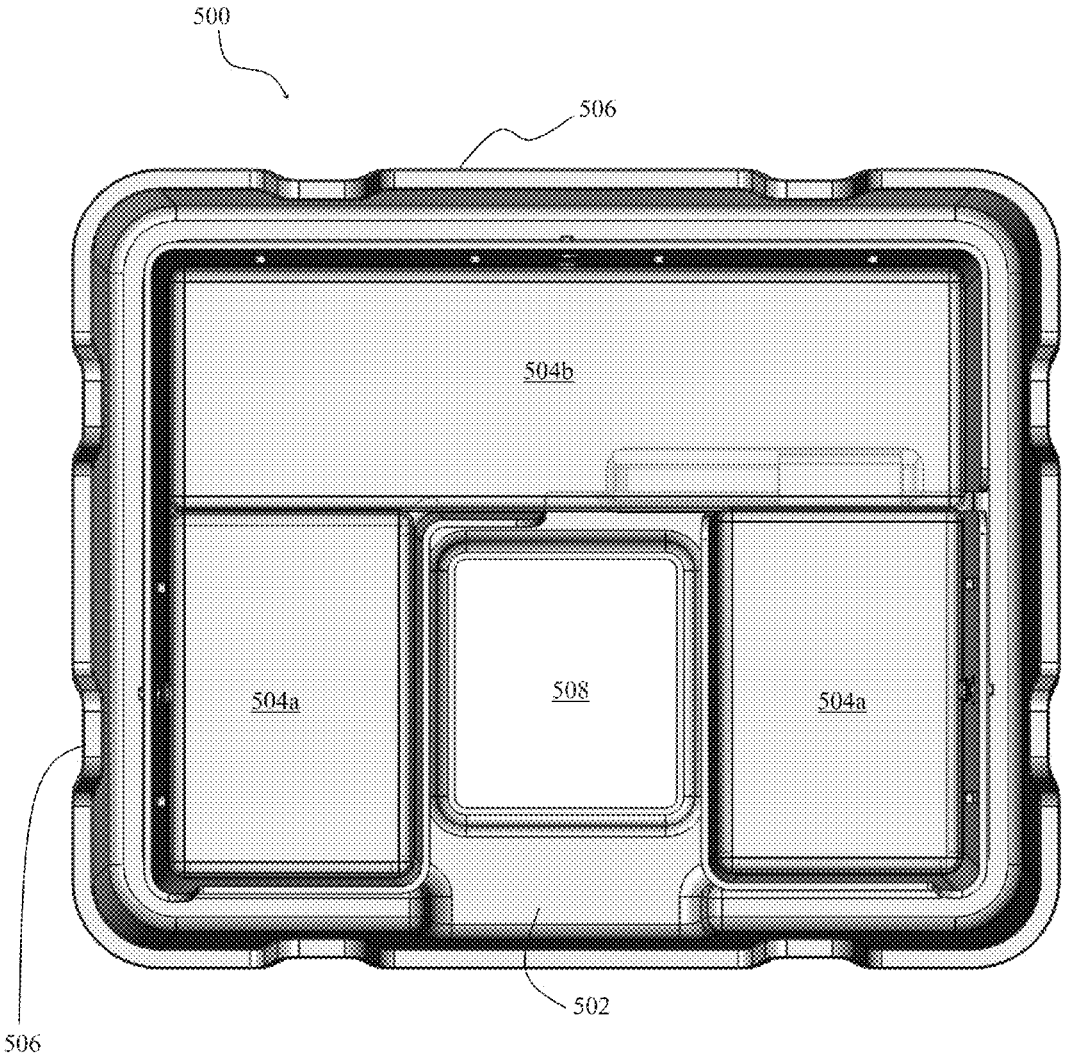
FIG. 5C is a perspective view of an alternative pod system in a contracted position according to an embodiment of the current invention.
Figure 5D:
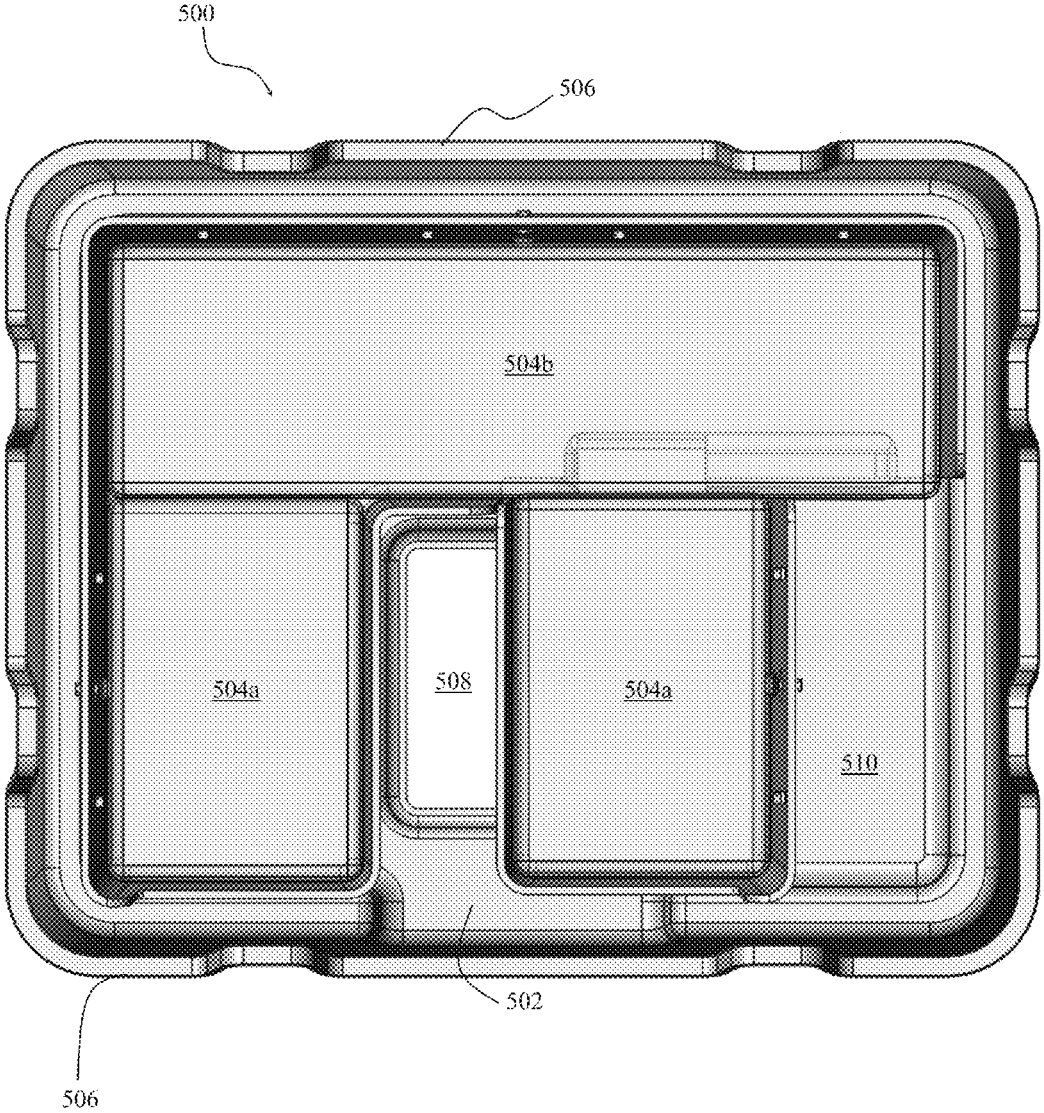
FIG. 5D is a top view of the pod system of FIG. 5C.

One of air cells 504*a* may be slidably engaged with base 502, such that air cell 504*a* can slide side-to-side, as can be seen in FIG. 5A versus FIG. 5B and also in FIG. 5C versus FIG. 5D. This allows opening 508 to become bigger in a more extended position (as in FIGS. 5A and 5C) or smaller in a more contracted position (as in FIGS. 5B and 5D). This allows system 500 to accommodate multiple sizes of patients' heads/faces. In the contracted position (FIGS. 5B and 5D), surface 510 may be exposed.

Triangular Wedge

In an embodiment, as seen in FIGS. 3A-3D, the current invention includes a low air loss triangular wedge system, generally denoted by the reference numeral 300. Triangular wedge system 300 includes base 308 (formed of foam, air cells, or other supportive material) supporting a top air cell layer, generally denoted by the reference numeral 304, that includes one or more porous or perforated air cells 306, though air cells 306 may rather be formed of a material that permits the flow of a fluid through the material, such as high vapor rate transmission fabrics (e.g., GORE-TEX). Base 308 and air cell layer 304 can be surrounded by perforated cover 302, though cover 302 may also rather be formed of a material that permits the flow of a fluid through the material, such as high vapor rate transmission fabrics (e.g., GORE-TEX). Cover 302 and air cell layer 304 would each have an aperture for receiving and connecting to accessory tubing 126 at point 128. Air cell layer 304 substantially covers the top contact surface of base 308 and thus has similar dimensions as, if not larger dimensions than, the top surface of base 308. Regardless of the number and dimensions of each air cell 306, it is contemplated that air cells 306 should cover the top contact surface of base 308.

Figure 3A:
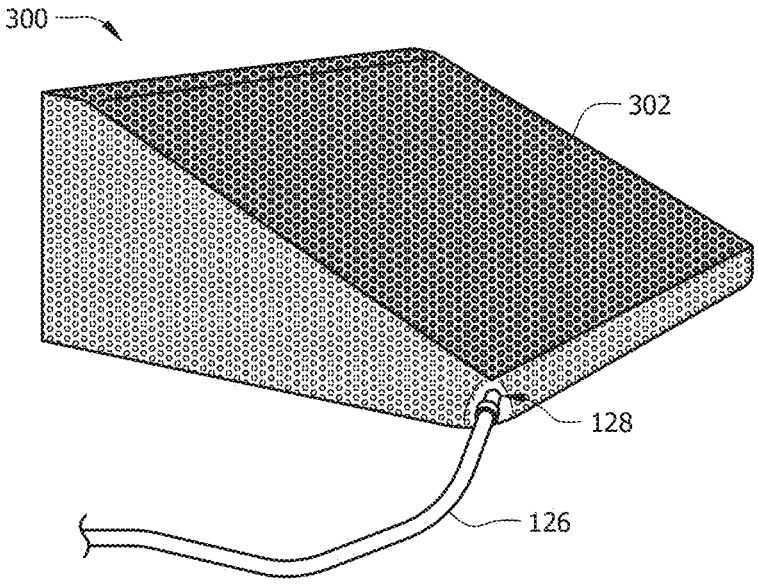
FIG. 3A is a perspective view of a low air loss triangular wedge, according to an embodiment of the current invention.
Figure 3B:
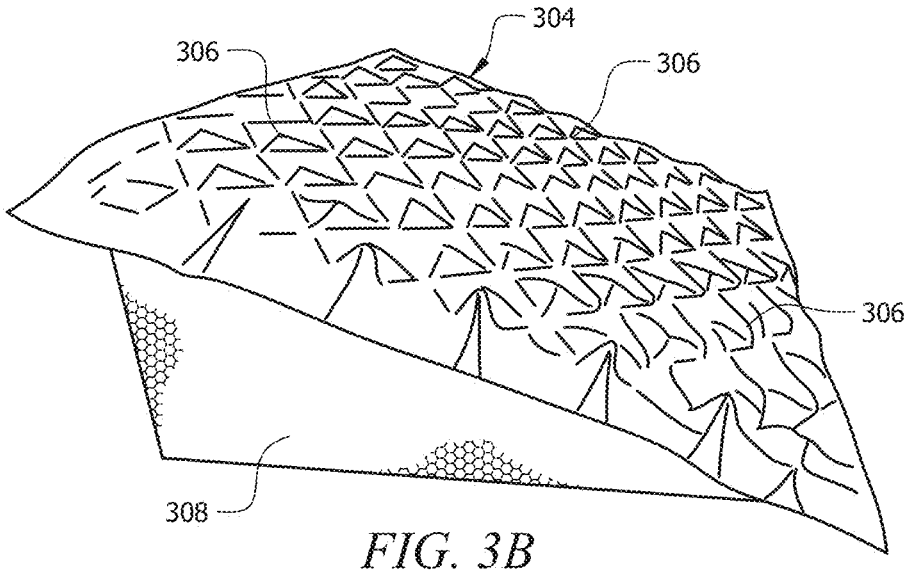
FIG. 3B shows the internal components of the triangular wedge of FIG. 3A.
Figure 3C:
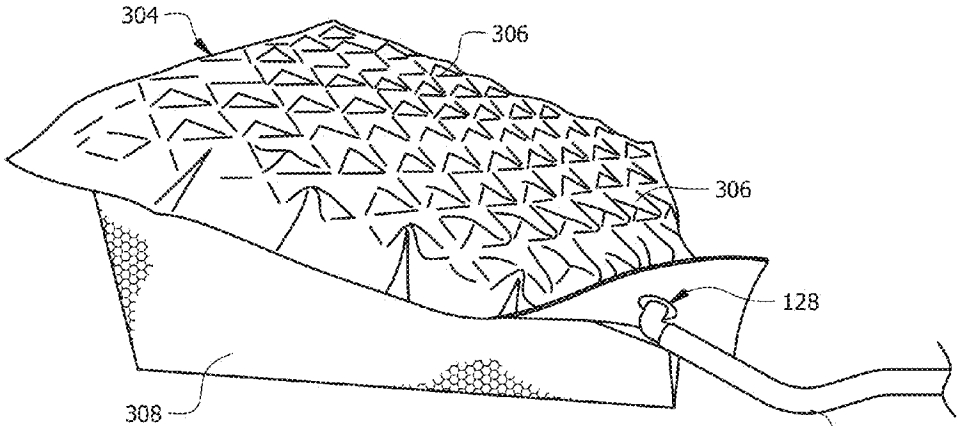
FIG. 3C is a close-up view of the connection between the port tubing and the triangular wedge of FIG. 3A.

If multiple air cells are present, as in FIG. 3B, each air cell 306 would be fluidly connected to one another via a connecting channel, such that inflating air cell layer 304 through a single connection point (e.g., point 128) of accessory tubing 126 would inflate each air cell 306.

In the embodiment shown in FIGS. 3A-3D, the top surface of base 308 is disposed at an approximately forty-five (45) degree angle relative to the bottom surface of base 308. The angle of the surface, however, is not limited to 45 degrees and may be any degree from zero (0) to ninety (90). Similarly, base 308 may be a variety of shapes and sizes depending on the desired use. Like base 308, air cell layer 304 (including air cells 306) may be a variety of shapes and sizes depending on the desired use.

Accessory tubing 126 is coupled on one end to triangular wedge system 300 at point 128 and is coupled on its opposite end to accessory port 110 (which is connected directly or indirectly to air pump 106, as discussed), directly to air pump 106, or other mechanism for inflating or continually pushing air into triangular wedge system 300.

Figure 3D:
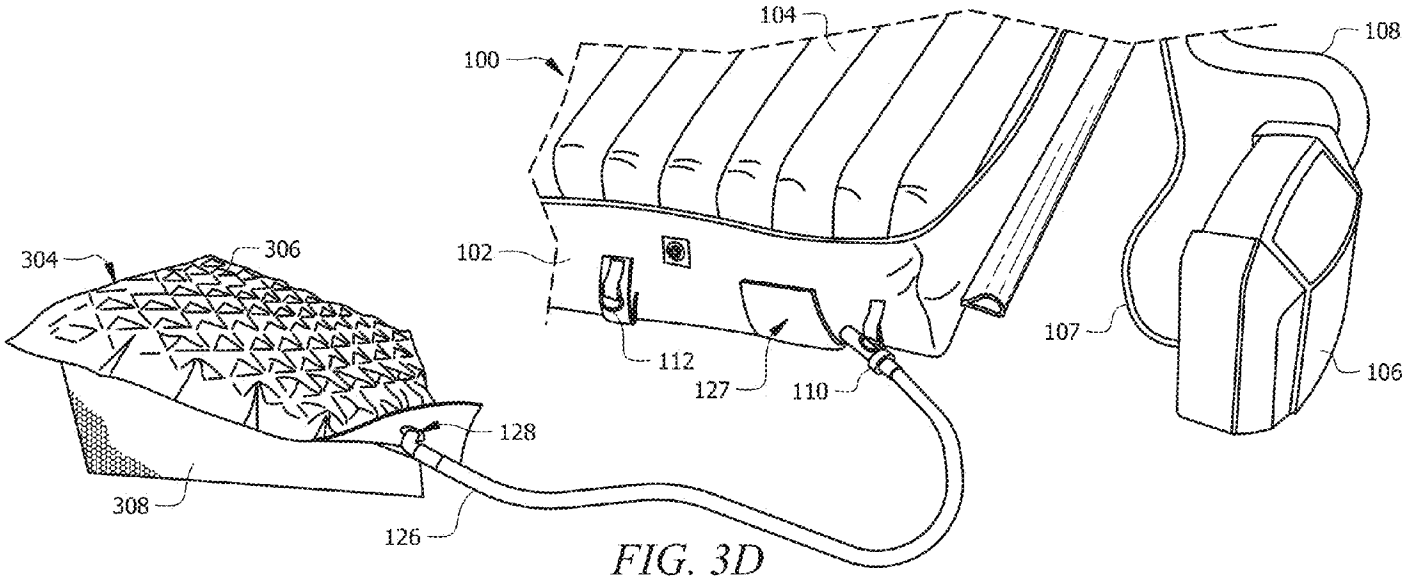
FIG. 3D is a perspective view of the connection between the mattress of FIG. 1A and the triangular wedge of FIG. 3A.

As shown in FIG. 3D, where triangular wedge system 300 is indirectly coupled to air pump 106, such that air pump 106 provides air flow into triangular wedge system 300, air or other fluid would be pumped from air pump 106 through air hose 108 and into manifold 114, thereby inflating manifold 114. Subsequently, because valve 120 and tubings 122*a*, 122*b* provide fluid communication between the interior of manifold(s) 114 and accessory port 110 when control mechanism 127 is disposed in an open position, air can be pushed from manifold 114 into accessory port 110 and thus into accessory tubing 126, thereby inflating or actuating triangular wedge system 300. Air would then flow out of the perforations in air cells 306 and cover 302 in triangular wedge system 300 and be replenished by additional air pumped in by air pump 106 through manifold 114.

It is contemplated herein that only the portion of cover 302 that would be contacted by the patient (the angled surface of FIG. 3A) is perforated, rather than the entirety of cover 302 being perforated. Alternatively, cover 302 may be formed of a material that permits the flow of a fluid through the material, such as high vapor rate transmission fabrics.

Triangular wedge system 300 allows a patient to elevate his/her legs on triangular wedge system 300 or lean his/her back or side against triangular wedge 300 while still utilizing low air loss therapy and/or alternating pressure therapy on the pressure points contacting triangular wedge system 300.

Cylindrical Wedge

In an embodiment, as seen in FIGS. 4A-4D, the current invention includes a low air loss cylindrical wedge system, generally denoted by the reference numeral 400. Cylindrical wedge system 400 includes base 406 (formed of foam, air cells, or other supportive material) surrounded by a plurality of porous or perforated air cells 404, though air cells 404 may rather be formed of a material that permits the flow of a fluid through the material, such as high vapor rate transmission fabrics (e.g., GORE-TEX). Base 406 and air cells 404 can be surrounded by perforated cover 402, though cover 402 may also rather be formed of a material that permits the flow of a fluid through the material, such as high vapor rate transmission fabrics (e.g., GORE-TEX). Cover 402 would have an aperture for receiving and connecting to accessory tubing 126 at point 128. Air cells 404 substantially cover the outer contact surface of base 406. Air cells 404 can abut each other along their respective longitudinal axes, so that there are a sufficient number of air cells 100 to be disposed around the circumference of base 406. Regardless of the number and dimensions of each air cell 404, it is contemplated that air cells 404 should cover the outer contact surface of base 406.

Accessory tubing 126 is coupled on one end to cylindrical wedge system 400 at point 128 and is coupled on its opposite end to accessory port 110 (which is connected directly or indirectly to air pump 106, as discussed), directly to air pump 106, or other mechanism for inflating or continually pushing air into cylindrical wedge system 400.

Figure 4A:
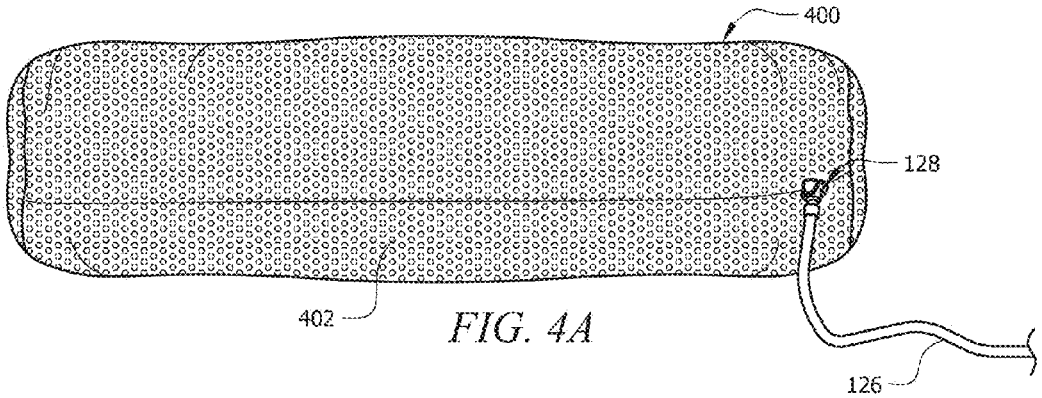
FIG. 4A is an elevated view of a low air loss cylindrical wedge, according to an embodiment of the current invention.
Figure 4B:
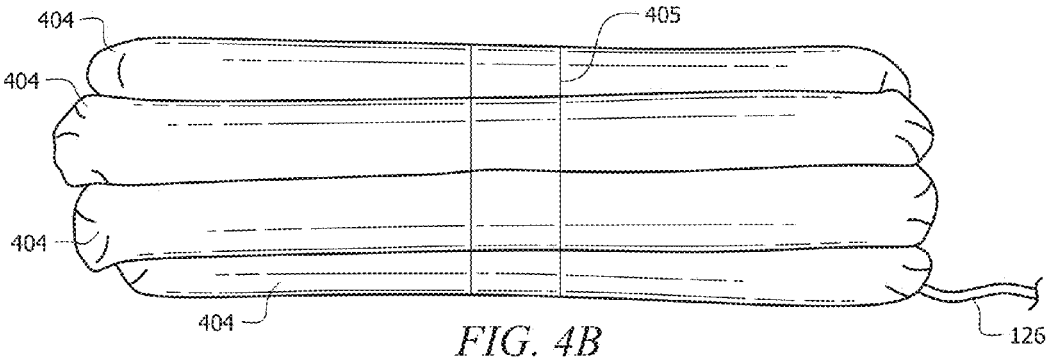
FIG. 4B is a side view of the internal components of the cylindrical wedge of FIG. 4A.
Figure 4C:
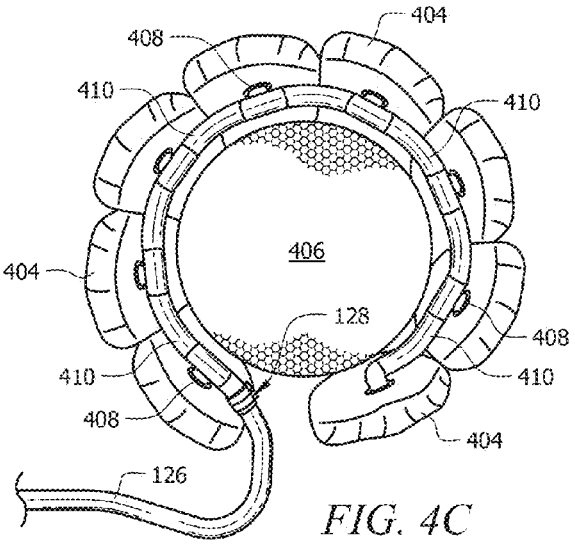
FIG. 4C is an end view of the internal components of the cylindrical wedge of FIG. 4A.

If multiple air cells are present, as in FIGS. 4B-4C, each air cell 404 would be fluidly connected to one another via manifold 410 with connector 408 providing fluid communication between manifold 410 and each air cell 404, such that inflating air cells 404 through a single connection point (e.g., point 128) of accessory tubing 126 would inflate each air cell 404 through manifold 410 and connectors 408.

Manifold 410 would be coupled to each of air cells 404 via connector 408. Connectors 408 provide open communication between their interiors and the interiors of air cells 404. Connectors 408 may be rigid so as to preserve airflow between manifold 410 and air cells 404 around the circumference of base 406. In this particular embodiment as well, connector 408 would be present between each air cell 404 and manifold 410.

Fitting 405 may be positioned around air cells 404 to maintain the configuration of air cells 404 around base 406.

Figure 4D:
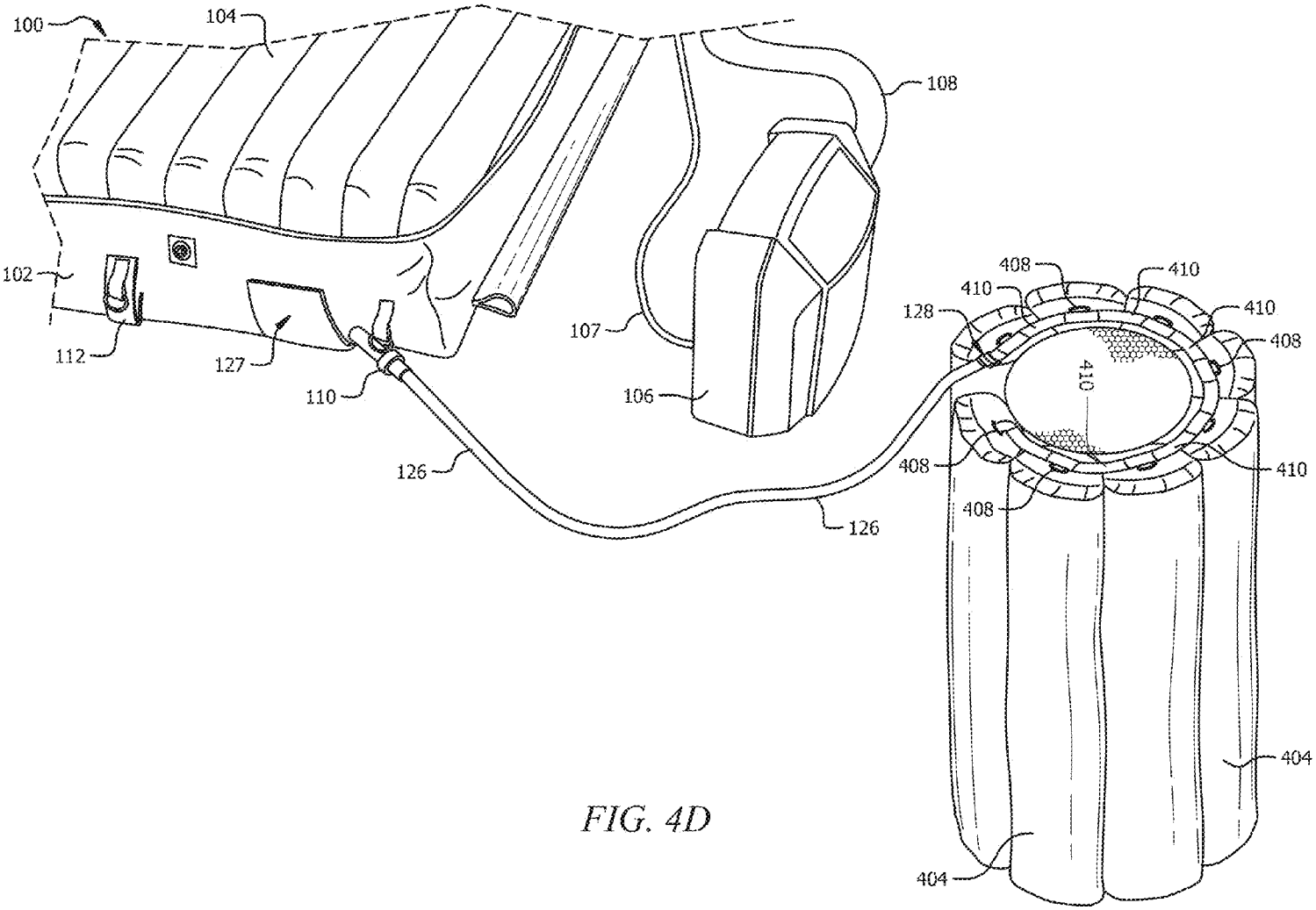
FIG. 4D shows the connection between the mattress of FIG. 1A and the cylindrical wedge of FIG. 4A.

As shown in FIG. 4D, where cylindrical wedge system 400 is indirectly coupled to air pump 106, such that air pump 106 provides air flow into cylindrical wedge system 400, air or other fluid would be pumped from air pump 106 through air hose 108 and into manifold 114, thereby inflating manifold 114. Subsequently, because valve 120 and tubings 122*a*, 122*b* provide fluid communication between the interior of manifold(s) 114 and accessory port 110 when control mechanism 127 is disposed in an open position, air can be pushed from manifold 114 into accessory port 110 and thus into accessory tubing 126. Then air can continue its path of travel through accessory tubing 126 and into manifold 410 and subsequently into each of connectors 408, thereby inflating or actuating cylindrical wedge system 400. Air would then flow out of the perforations in air cells 404 and cover 402 in cylindrical wedge system 400 and be replenished by additional air pumped in by air pump 106 through manifold 114.

Cylindrical wedge system 400 allows a patient to elevate his/her legs or other body parts on cylindrical wedge system 400 while still utilizing low air loss therapy and/or alternating pressure therapy on the pressure points contacting cylindrical wedge system 400.

Glossary of Claim Terms

Accessory port: This term is used herein to refer to an opening or structure for the intake or exhaust of air or other fluid. As used herein, the accessory port connects a low air loss accessory (e.g., pillow/pod, patient positioning wedge, etc.) to a low air loss mattress (and thus to the air source/pump). An accessory port may have any number and be located anywhere along the mattress system. For example, it may be disposed in each corner of a mattress, providing the ability to connect four (4) or more accessories to the mattress (and thus to the air source/pump) for optimal patient positioning and low air loss therapy.

Air cell: This term is used herein to refer to a substantially hollow pouch or containment that can be inflated to support parts of a patient's body and allow air or other fluid to be pumped into it and to exit from it through the perforations. Air cells can be porous or perforated to permit fluid flow or can be formed of a material that permits the flow of a fluid through the material, such as high vapor rate transmission fabrics (e.g., GORE-TEX).

Air distribution manifold: This term is used herein to refer to an apparatus that has multiple outlets for distributing air or other fluid from an air source (e.g., air pump) into a multitude of recipients (e.g., air cells).

Air source: This term is used herein to refer to any device that can continuously push air or other fluid. An example of an air source is an air pump.

Alternately coupled: This term is used herein to refer to a configuration of connections between manifolds and air cells. Specifically, a first manifold would be coupled to every other air cell, and a second manifold would be coupled to every other air cell to which the first manifold was not coupled. In other words, for example, if four (4) air cells are present, the first manifold could be coupled to the first and third air cell, and the second manifold could be coupled to the second and fourth air cell.

Angled surface: This term is used herein to refer to a contact surface of a patient positioning wedge having a triangular prismic shape. Typically, this would be the top surface and would permit the exit of air or other fluid.

Contact surface: This term is used herein to refer to a face of a base of a patient positioning wedge that may be intended to be physically touched by the patient. For example, in a triangular prismic wedge, the contact surface typically is the angled top surface. Contrastingly, in a cylindrical wedge, the contact surface could be any surface around the circumference of the base since any outer part of the wedge could be used to reposition the patient. Typically, however, this contact surface isn't actually physically contacted since a layer of air cells would cover or surround the contact surface, such that the patient would actually physically touch the air cell(s) covering the contact surface.

Control mechanism: This term is used herein to refer to a component of a control valve that directs the control valve to open, partially obstruct, or completely close a passageway between two structures, such that fluid flow between the two structures can be regulated or controlled.

Control valve: This term is used herein to refer to a device that regulates, directs, or otherwise controls fluid flow between two components by opening, partially obstructing, or completely closing passageways between the two components.

Controlled communication: This term is used herein to refer to a relationship between two separate components where fluid flow between the two components can be controlled (e.g., open, closed, slowed, etc.).

Fluid communication: This term is used herein to refer to a relationship between two separate components where fluid flow between the two components is constant (i.e., open).

Patient positioning wedge: This term is used herein to refer to any apparatus that can help reposition a patient or any part of a patient's anatomy (e.g., arm, foot, skin folds, etc.) in a suitable configuration in order to optimize the effects of low air loss or alternating pressure therapy. A patient positioning wedge can have any shape, for example a triangular prismic shape or a cylindrical shape, as long as the wedge can lift or otherwise reposition the patient or body part.

Porous: This term is used herein to refer to a particular, typically thin, structure (such as lining of cover or air cell) having an array of small or even microscopic apertures to permit fluid flow therethrough. The term "porous" can refer to a material being perforated or to an alternative material that permits the flow of a fluid through the material, such as high vapor rate transmission fabrics (e.g., GORE-TEX).

Resilient: This term is used herein to refer to a material being capable of withstanding shock or force without permanent deformation or rupture. An example of a resilient material is foam.

Triangular prismic shape: This term is used herein to refer to a shape of a patient positioning wedge that has a thicker edge and is tapered to a thinner edge, such that a side view of the shape would resemble a triangle (e.g., right triangle), as in FIG. 3A. The thinner edge would be inserted or "wedged" between the patient and the mattress to elevate that part of the patient's body.

Vertical confines of sidewalls: This term is used herein to refer to the vertical borders of the frame of the mattress, as can be seen in FIGS. 1A and 1C. As indicated in those particular figures, the air cells remains within the vertical boundaries of the frame of the mattress.

The advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A low air loss patient positioning wedge system, comprising:

a resilient, non-porous base having an outer surface, said outer surface being any side of said base intended to reposition a targeted body part of a user thereof; and a porous air cell layer formed of one or more perforated air cells covering or surrounding said outer surface of said base, such that said user would not physically contact said outer surface of said base, said one or more air cells each having a substantially hollow interior, said porous air cell layer being powered, inflated, and controlled by a low air loss mattress via an accessory port on said low air loss mattress and an elongate tubing disposed through a first aperture in said air cell layer in order to provide fluid communication between said low air loss mattress and said interior of said each air cell, said low air loss mattress being directly or indirectly coupled to an air source, wherein flow of a fluid follows a path of travel from said air source, into said low air loss mattress, through said accessory port, through said tubing, into said substantially hollow interior of said each air cell through said first aperture, through perforations of said each air cell, and into an environment external to said wedge system.

2. A system as in claim 1, further comprising:

a porous cover surrounding said base and said air cell layer, said porous cover having a second aperture, said first aperture and said second aperture being aligned with each other, said tubing disposed through said second aperture to reach said first aperture in order to provide fluid communication between said air source and said interior of said each air cell, wherein fluid flow follows said path of travel from said air source, through said tubing, into said substantially hollow interior of said each air cell through said first and second apertures, through perforations of said each air cell, through perforations of said cover, and into an environment external to said wedge system.

3. A system as in claim 1, further comprising:

said base having a generally triangular prismic shape, said contact surface being a substantially planar, angled surface, said angled surface being covered by said air cell layer.

4. A system as in claim 3, further comprising:

said air cell layer being substantially planar and formed of a plurality of air cells with a fluid channel disposed between each of said plurality of air cells.

5. A system as in claim 1, further comprising:

said base having a generally cylindrical shape, said outer surface being a circumference of said base, said cylindrical base surrounded by said air cell layer.

6. A system as in claim 5, further comprising:

said one or more perforated air cells being a plurality of elongate air cells each defining a longitudinal axis, said longitudinal axis of said each elongate air cell being disposed substantially parallel to a longitudinal axis of said cylindrical base, said plurality of elongate air cells abutting each other along said longitudinal axis of said each elongate air cell around said circumference of said cylindrical base.

7. A patient positioning wedge system as in claim 6, further comprising:

an air distribution manifold coupled on one end to said elongate tubing and further coupled to said each air cell for the distribution of said fluid from said air distribution manifold into said each air cell in order to provide fluid communication between said air source and said interior of said each air cell.

* * * * *